US006017443A

United States Patent [19]

Buchanan

[11] Patent Number: 6,017,443

[45] Date of Patent: Jan. 25, 2000

[54] HYDROPROCESSING PROCESS HAVING STAGED REACTION ZONES

[75] Inventor: John S. Buchanan, Trenton, N.J.

[73] Assignee: Mobil Oil Corporation, Fairfax, Va.

[21] Appl. No.: 09/019,008

[22] Filed: Feb. 5, 1998

[51] Int. Cl.[7] ..... C10G 65/02; C10G 65/04; C10G 45/00

[52] U.S. Cl. ..... 208/210; 208/57; 208/59; 208/89; 208/97; 208/211; 208/212

[58] Field of Search ..... 208/59, 89, 210, 208/211, 212, 97, 57

[56] References Cited

U.S. PATENT DOCUMENTS

| | | | |
|---|---|---|---|
| 2,952,626 | 9/1960 | Kelley et al. | 208/210 |
| 3,017,345 | 1/1962 | Eastman | 208/210 |
| 3,091,586 | 5/1963 | Pappas et al. | 208/210 |
| 3,172,836 | 3/1965 | Robbers | 208/59 |
| 3,328,290 | 6/1967 | Hengstebeck | 208/89 |
| 3,600,299 | 8/1971 | Koller | 208/59 |
| 4,021,330 | 5/1977 | Satchell, Jr. | 208/89 |
| 4,615,789 | 10/1986 | Bridge et al. | 208/143 |
| 4,749,469 | 6/1988 | Beerbaum | 208/72 |
| 4,755,281 | 7/1988 | Penick | 208/108 |
| 5,183,556 | 2/1993 | Reilly et al. | 208/57 |
| 5,474,670 | 12/1995 | Daage et al. | 208/210 |
| 5,603,824 | 2/1997 | Kyan et al. | 208/208 R |
| 5,705,052 | 1/1998 | Gupta | 208/210 |
| 5,720,872 | 2/1998 | Gupta | 208/210 |

*Primary Examiner*—Walter D. Griffin
*Attorney, Agent, or Firm*—Penny L. Prater; Malcolm D. Keen

[57] ABSTRACT

A method and reactor for catalytic hydroprocessing liquid hydrocarbon feedstock at elevated temperatures and pressures for producing a liquid hydrocarbon product involves introducing the feedstock into a reactor having upper and lower reaction zones, each reaction zone having a hydroprocessing catalyst bed therein, the feedstock being introduced at the top of the lower reaction zone for downward flow through and reaction within the catalyst bed therein; collecting a partially reacted liquid effluent from the lower reaction zone; pumping the partially reacted liquid effluent to and introducing it at the top of the upper reaction zone for downward flow through and reaction within the catalyst bed therein; introducing hydrogen gas at the top of the upper reaction zone for flow downwardly and sequentially through and over the catalyst beds in the upper and lower reaction zones in co-current contact with the liquid in the reaction zones, the hydrogen reacting with the liquid in the reaction zones whereby the liquid effluent from the upper reaction zone comprises a liquid hydrocarbon product; and collecting and recovering the liquid hydrocarbon effluent product from the upper reaction zone.

11 Claims, 4 Drawing Sheets

HYDROPROCESSING PROCESS HAVING STAGED REACTION ZONES

BACKGROUND OF THE INVENTION

1. Field of the Invention

The present invention relates to hydroprocessing methods and reactors and, more particularly, to multiple bed downflow reactors for the catalytic hydroprocessing of hydrocarbons.

2. Description of the Prior Art

The reaction of hydrocarbons, particularly heavier petroleum feedstocks such as distillates, lubricants, heavy oil fractions, residuum, etc., usually in the presence of a catalyst and elevated temperatures and pressures, is known as hydroprocessing. Typical hydroprocessing processes include hydrodesulfurization, hydrodenitrification, hydroisomerization, hydrodemetallation, hydrocracking, hydrogenation, and the like. A hydroprocessing reactor may have two or more catalytic beds containing the same or different catalysts, depending upon the intended utility of the beds. Therefore, depending upon the catalysts, two or more of these processes may be carried on in the same reactor.

In a typical hydroprocessing reactor, for example for desulfurization, a vertical reactor is divided into one or more catalyst-containing zones. Liquid feed is introduced at the top of the reactor together with the hydrogen gas and the liquid feed in co-current contact with the hydrogen gas passes through a catalyst bed containing a desulfurization catalyst. The more labile feed components react quickly, diluting the hydrogen with $H_2S$ (which can inhibit the desired reactions) and with light hydrocarbon gases. The liquid leaving the bottom of the reactor is in contact with gas containing the highest amount of $H_2S$ and light hydrocarbon gases and a relatively low hydrogen partial pressure, which limits the extent of sulfur removal.

In another hydrodesulfurization reactor, liquid feed is introduced at the top of the reactor and flows downwardly through the desulfurization catalyst bed. Hydrogen gas is directed under pressure into the bottom of the reactor and flows upwardly through the catalyst bed in countercurrent contact with the downflowing liquid feed. In this arrangement, exiting liquid at the bottom of the reactor is in contact with the fresh incoming hydrogen gas, which contributes to very high reaction rates and desulfurization yields. However, countercurrent flow in a packed bed containing small catalyst particles is problematic and is to be avoided where possible.

In still another hydrodesulfurization processes, the reactor includes two or more vertically stacked catalyst beds. Hydrogen gas is fed co-currently with the liquid feed to an upper desulfurization zone in the presence of a desulfurization catalyst. Liquid effluent from the first zone flows downwardly to a lower desulfurization zone wherein the liquid effluent is contacted with a countercurrent flow of hydrogen in the presence of a desulfurization catalyst. This combined co-current-countercurrent process mitigates some of the reaction rate and yield disadvantages of conventional co-current process but suffers all of the disadvantages of countercurrent flow in packed beds containing small catalyst particles.

Currently a large number of hydrodesulfurization and other hydroprocessing reaction systems experience extremely unfavorable kinetic conditions or utilize countercurrent flow, with its inherent disadvantages, to improve the kinetics performance of the processes. Accordingly, a hydroprocessing technique that would improve overall kinetics efficiency while maintaining conventional co-current downflow through the catalyst beds would be desirable.

SUMMARY OF THE INVENTION

It is, therefore, an object of the present invention to provide an economical hydrodesulfurization or other hydroprocessing reaction system which utilizes co-current downflow of liquid feed through the catalyst beds.

It is another object of the present invention to provide an economical hydrodesulfurization or other hydroprocessing reaction system which enjoys much of the kinetics benefit typically associated with countercurrent gas-liquid flow without the disadvantages inherent in processes utilizing countercurrent flow in packed beds with small catalyst particles.

It is still another object of the present invention to provide an improved hydroprocessing technique which permits deeper conversion of the liquid feed.

It is yet another object of the present invention to provide an improved hydroprocessing technique which provides increased throughput at constant levels of liquid feed conversion.

It is another object of the present invention to provide an improved hydroprocessing technique utilizing a multiple catalyst bed reactor which allows the use of different catalysts in the different beds.

These objects and others are achieved by providing a hydroprocessing method comprising introducing a liquid feedstock into a reactor having at least first and second reaction zones, each reaction zone having a hydroprocessing catalyst bed therein, introducing the liquid feedstock at the top of the second reaction zone for downward flow through the catalyst bed therein to the base of the reactor, collecting and withdrawing the liquid at the base of the reactor, directing the liquid to the top of the reactor and introducing it at the top of the first reaction zone for downward flow through the catalyst bed therein, introducing hydrogen gas under pressure at the top of the first reaction zone for downward sequential flow through the first and second reaction zones in co-current contact with the liquid feed in the reaction zones, and collecting and withdrawing product liquid (e.g., having a low sulfur content in a hydrodesulfurization process) at the bottom of the first reaction zone.

In a preferred aspect of the invention the first and second reaction zones are vertically spaced apart in a single reactor vessel with the first reaction zone above the second reaction zone and the liquid effluent from the second reaction zone is pumped to the top of the first reaction zone.

DESCRIPTION OF THE PREFERRED EMBODIMENT

In accordance with a preferred form of the present invention there is provided a hydroprocessing method in which a liquid feedstock is reacted with a predominantly hydrogen gaseous reactant in a reactor having upper and lower reaction zones, each reaction zone having a hydroprocessing catalyst bed therein. The liquid feedstock is introduced at the top of the lower reaction zone for downward flow through the catalyst bed therein to the base of the reactor at which point the liquid is collected and withdrawn and pumped to the top of the reactor where it is introduced at the top of the upper reaction zone. The liquid from the bottom of the lower reaction zone flows co-currently downwardly through the catalyst bed in the upper reaction zone together with hydrogen gas introduced under pressure at the top of the upper reaction zone. At the bottom of the upper reaction zone the product liquid (e.g., liquid having achieved an acceptably low sulfur content in a desulfurization process) is collected and withdrawn. In this manner, liquid feedstock flows downwardly through each of the reaction zones in co-current contact with the gaseous hydrogen.

Figure 1:
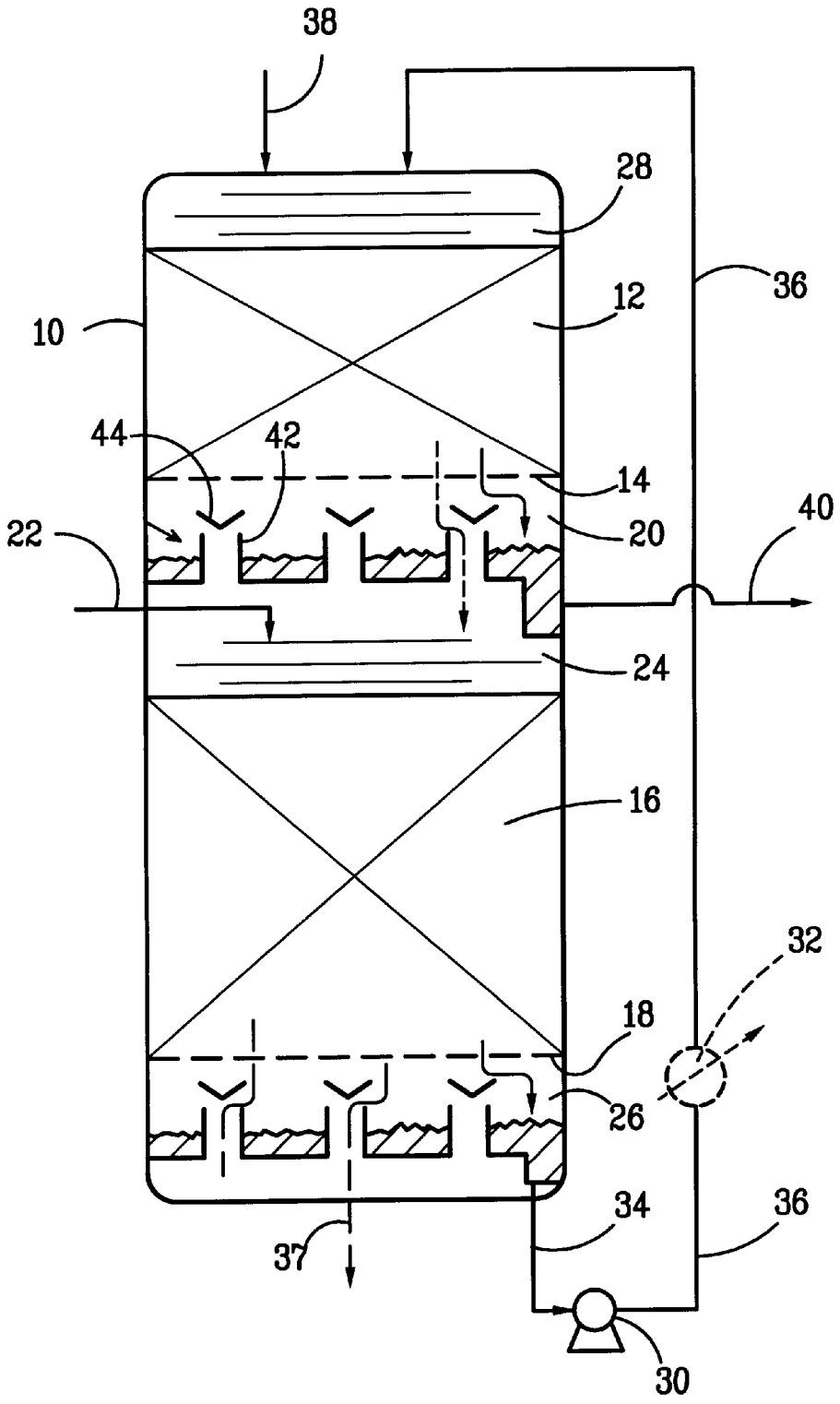
FIG. 1 is a simplified process diagram showing a vertical reactor with fixed catalyst beds and major flow streams in connection with one preferred embodiment of the present invention.

Referring now to the drawings and particularly to FIG. 1, a continuous catalytic hydroprocessing reactor system is shown for treating a liquid feedstock with a gaseous, predominantly hydrogen, reactant. Reactor 10 is a cylindrical column, typically constructed of steel or iron or other pressure-retaining metal, which is capable of withstanding corrosion as well as the elevated temperatures and pressures experienced during hydroprocessing. Such reactors are conventional and need not be described in detail. Reactor 10 contains two vertically spaced catalyst beds, upper bed 12 supported on catalyst support grid 14 and lower bed 16 supported on catalyst support grid 18. The catalyst support grids are typically perforated or foraminous plates or their equivalent, which are well known in the art, and divide the reactor into upper and lower reaction zones. Each of the beds is packed with a hydroprocessing catalyst which is suitable for the hydroprocessing reaction system which is intended to occur in the particular reaction zone, e.g., hydrodesulfurization. As will be seen from the discussion which follows, one of the particular advantages of the process of the present invention is that it permits the use of a different catalyst in the upper bed than is used in the lower bed. Moreover, although the illustrated hydroprocessing system is shown as comprising two vertically spaced apart reaction zones in a single reactor, it will be appreciated that there can be multiple reaction zones and the reaction zones can be physically located in one or more separate reactors which need not, necessarily, be oriented to permit sequential liquid feedstock flow therethrough via gravity.

The catalyst beds, 12, 16 are separated by an intervening gas-liquid separation and liquid collection zone 20 in which the liquid product is removed, a liquid feed line 22 for introducing liquid feedstock to the upper end of the lower reaction zone and a gas-liquid distributor 24 for assuring full and adequate dispersion of the downflowing hydrogen-containing gas from the upper reaction zone (shown in dashed lines) which passes through gas-liquid separator 20 and the liquid feedstock introduced through liquid feed line 22 above the lower reaction zone and for uniformly distributing the liquid feedstock and gas over the lower catalyst bed. At the bottom of reactor 10, below lower catalyst bed 16, is a second gas-liquid separation and liquid collection zone 26 for separating the gas effluent 37 from the liquid which has just passed through catalyst bed 16 before the liquid is collected and pumped up to the top of reactor 10. Both gas-liquid separation zones 20, 26 have as their purpose to collect the liquid exiting the catalyst bed and to allow the gas exiting the catalyst bed to pass through. For this purpose, chimney trays 42 with V-hats 44 of the type commonly used in fractionation towers to collect liquid in the presence of upflowing gas are believed to be suitable. These same trays will work in the presence of downflowing gas although the overhang of the V-hats may, in some instances, have to be extended to assure that all downflowing liquid is collected. Other devices which collect liquid while allowing gas downflow could also be used in this application. Another gas-liquid distributor 28 is positioned at the top of reactor 10 above catalyst bed 12 to assure full and adequate dispersion of the predominantly hydrogen gas feed introduced at the top of reactor 10 in the liquid pumped-up from gas-liquid separator 26 and to uniformly distribute the pumped-up liquid and gas feed over the upper catalyst bed 12.

In operation, for example for a desulfurization process and reactor, liquid feedstock comprising sulfur-contaminated hydrocarbon feed is pumped via liquid feed line 22 into the top of the lower reaction zone of reactor 10 above catalyst bed 16 and through gas-liquid distributor 24. Typically, the feedstock is in a preheated condition as a result of passage through upstream heat exchangers (not shown). The preheated liquid feedstock flows downwardly through lower catalyst bed 16 in co-current contact with a hydrogen-containing gaseous stream from the upper reaction zone, as will be more fully described hereinafter. In the lower catalyst bed 16, most of the sulfur is removed from the liquid feedstock, hydrogen is consumed in the desulfurization reaction which takes place, hydrogen sulfide and, possibly, ammonia are produced and low boiling hydrocarbons in the liquid feedstock are vaporized. The resulting, largely desulfurized liquid, which comprises mostly higher boiling hydrocarbons (generally boiling above 500° F.) is collected for further treatment in the upper reaction zone. The gaseous stream comprising hydrogen sulfide, unreacted hydrogen and lower boiling hydrocarbon vapors, passes through gas-liquid separator 26 at the bottom of reactor 10, and is optionally directed to a gas treatment stage in which a hydrogen rich stream may be separated and recycled to the top of reactor 10 for introduction to the upper reaction zone with the fresh hydrogen feed.

The largely desulfurized liquid exiting lower catalyst bed 16 is collected by gas-liquid separator 26 and is directed via conduit 34 to pump 30 for pumping via conduit 36, through optional heat exchanger 32 to cool the pumped-up liquid, to the top of reactor 10 for further processing before final discharge from reactor 10.

One advantage of utilizing optional heat exchanger 32 is that it can cool the liquid stream sufficiently that at least some inter-bed hydrogen quench gas can be diverted to be used as feed hydrogen. Indeed, in a reactor having only two beds which normally utilizes a single inter-bed quench gas stream, the use of optional heat exchanger 32 may completely eliminate the need for the quench gas stream. The fresh hydrogen gas stream introduced via gas feed line 38 and largely desulfurized liquid pumped-up from the bottom of reactor 10 are distributed over upper catalyst bed 12 by gas-liquid distributor 28 and flow downwardly through upper catalyst bed 12 in co-current contact. Further desulfurization occurs in the upper catalyst bed, producing a still further desulfurized product liquid and a vapor containing unreacted hydrogen as well as hydrogen sulfide, light hydrocarbon gas and, possibly, ammonia. The vapor continues through gas-liquid separation zone 20 into the lower reaction zone where it mixes with the fresh liquid feedstock introduced through liquid feed line 22 and reacts with the fresh liquid feed over the lower bed catalyst 16. The liquid exiting upper catalyst bed 12 is a highly desulfurized product liquid and is collected by gas-liquid separator 20 and directed via product line 40 for storage or further processing.

The gas phase effluent from the lower end of reactor 10 contains excess hydrogen, hydrogen sulfide, vaporized low boiling hydrocarbons of a composition generally similar to that of the lower boiling components of the liquid feedstock, possibly some ammonia and inert gaseous components. As an optional method for recovering recycle hydrogen for use in the hydroprocessing reactor, the gas phase effluent may be cooled to condense the vaporized liquid components, passed to a separator to separate the condensed liquid from the gas phase, vented to prevent the buildup of inert gaseous impurities in the system, scrubbed to remove hydrogen sulfide, as by amine absorption or other suitable processing, compressed to increase the pressure of the hydrogen sulfide-free hydrogen and directed into admixture with the fresh hydrogen feed introduced through gas feed line 38 at the top of reactor 10.

It will be appreciated that the herein described configuration of reactors and arrangement of streams captures much of the kinetics benefit that would be expected for fill counter-current flow, without experiencing the disadvantages of counter-current flow, while maintaining conventional co-current downflow through the catalyst beds. Stated otherwise, the flow through each reaction zone is conventional co-current downflow but the arrangement of streams between the reaction zones is counter-current. Thus, the method and reactor of the present invention involves staged operation which lies between full co-current downflow and full counter-current flow. The invention may be practiced and the benefits thereof realized not only with two reaction zones as already described, but with three or more reaction zones as well, preferably in a single reactor vessel, to achieve deeper conversion. In a more than two reaction zone system, wherein multiple reaction zones are successively arranged from upstream to downstream for continuous flow therethrough, preheated liquid feedstock comprising sulfur-contaminated hydrocarbon feed is introduced into the top of the most downstream reaction zone. Fresh hydrogen feed gas is introduced into the top of the most upstream reaction zone and flows downwardly through the catalyst bed of each successive reaction zone. The preheated liquid feedstock flows downwardly through the catalyst bed of the most downstream reaction zone in co-current contact with and reacts with the hydrogen-containing gas stream exiting the immediately prior upstream reaction zone, which is the second most downstream reaction zone. The partially desulfurized liquid effluent from the most downstream reaction zone is collected for further treatment in the second most downstream reaction zone while the gaseous stream effluent is optionally directed to a gas treatment stage in which a hydrogen rich stream may be separated and recycled to the most upstream reaction zone for use as feed hydrogen.

The partially desulfurized liquid exiting the most downstream reaction zone is pumped through an optional heat exchanger to the top of the second most downstream reaction zone for further processing. The hydrogen-containing gas stream exiting the third most downstream reaction zone and the liquid pumped from the most downstream reaction zone are distributed over the catalyst bed in the second most downstream reaction zone and flow downwardly through the catalyst bed in co-current contact and react therein. The vapor effluent from the second most downstream reaction zone continues into the most downstream reaction zone where it mixes and reacts with the fresh liquid feedstock introduced therein. The liquid effluent from the second most downstream reaction zone is collected and pumped through an optional heat exchanger to the top of the third most downstream reaction zone in which it admixes and reacts with the hydrogen-containing gas stream exiting the fourth most downstream reaction zone. It can be seen that this process can continue, irrespective of the number of reaction zones in the reactor system, with the effluent from each reaction zone being pumped to the top of the immediately prior upstream reaction zone in which it admixes and reacts with the downflowing hydrogen-containing gas stream. The effluent from the most upstream reaction zone is the very highly desulfurized product liquid and is directed to storage or for further processing.

Figure 2:
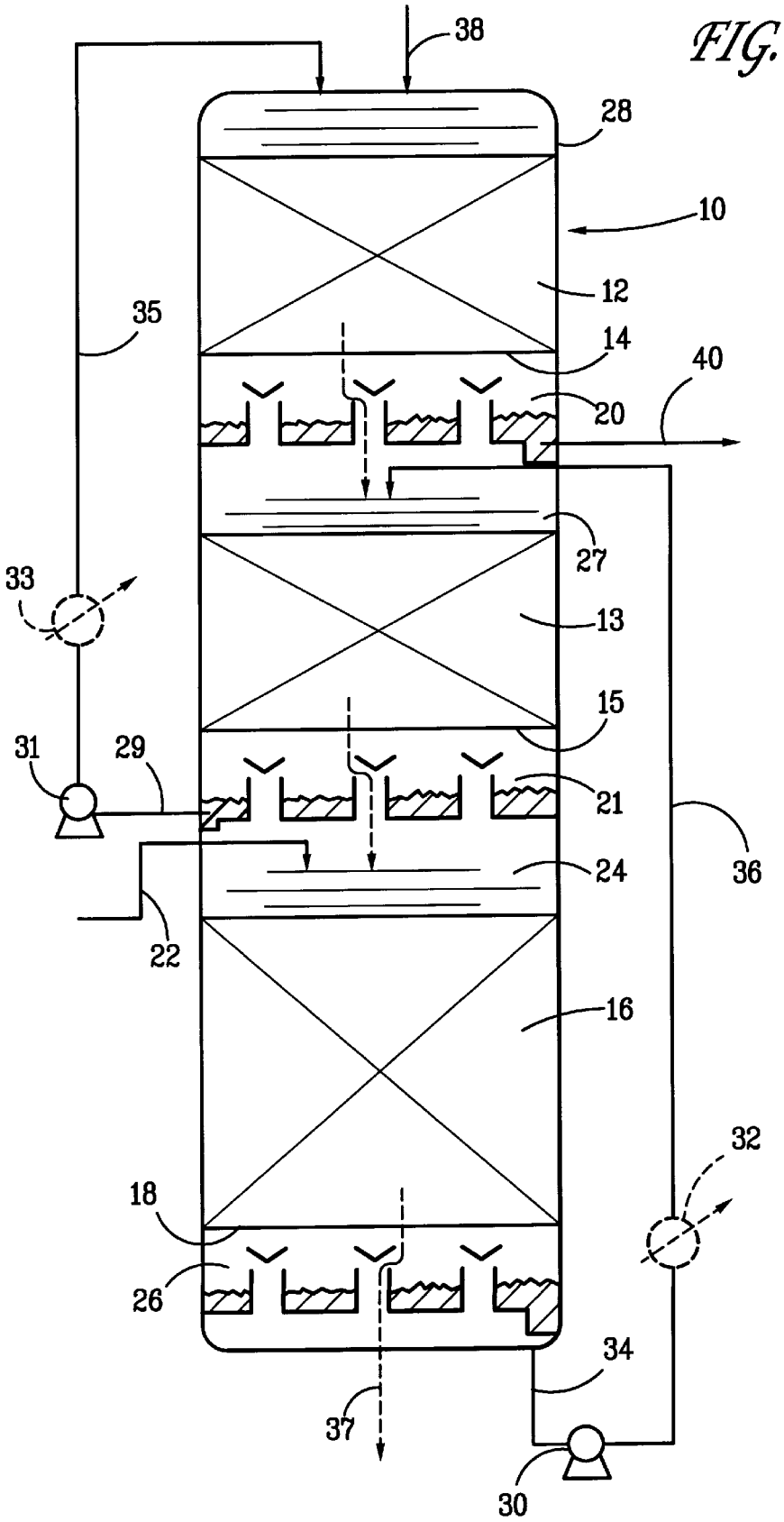
FIG. 2 is a simplified process diagram showing a vertical reactor with fixed catalyst beds and major flow streams in connection with another preferred embodiment of the present invention.

The operation of a three or more reaction zone system can be better understood from the three reaction zone system illustrated in FIG. 2, wherein like numerals designate like or equivalent elements in FIG. 1. Liquid feedstock comprising sulfur-contaminated hydrocarbon feed, which has been preheated, is pumped via feed line 22 into the top of the lower reaction zone of reactor 10 above catalyst bed 16 and through gas-liquid distributor 24. The preheated liquid feedstock flows downwardly through lower catalyst bed 16 in co-current contact with a hydrogen-containing gaseous stream from the middle reaction zone, as will be more fully described hereinafter. In the lower catalyst bed 16, most of the sulfur is removed from the liquid feedstock and the resulting, largely desulfurized liquid, which comprises mostly higher boiling hydrocarbons, is collected for further treatment in the other reaction zones. The gaseous stream comprising hydrogen sulfide, unreacted hydrogen and lower boiling hydrocarbon vapors, passes through gas liquid separator 26 at the bottom of reactor 10 and is optionally directed to a gas treatment stage in which a hydrogen rich stream may be separated and recycled to the top of reactor 10 for introduction to the upper reaction zone with the fresh hydrogen feed.

The largely desulfurized liquid exiting lower catalyst bed 16 is collected by gas-liquid separator 26 and is directed via conduit 34 to pump 30 for pumping via conduit 36, through optional heat exchanger 32 to cool the pumped-up liquid, to the top of the middle reaction zone for further processing. The hydrogen-containing gas stream from the upper reaction zone and largely desulfurized liquid pumped-up from the bottom of reactor 10 are distributed over middle catalyst bed 13 by gas-liquid distributor 27 and flow downwardly through middle catalyst bed 13 in co-current contact. Further desulfurization occurs in the middle catalyst bed, producing a still further desulfurized product liquid and a vapor containing unreacted hydrogen. The vapor continues through gas-liquid separation zone 21 into the lower reaction zone where it mixes with the fresh liquid feedstock introduced through liquid feed line 22 and reacts with the fresh liquid feed over the lower bed catalyst 16. The liquid exiting middle catalyst bed 13 is a highly desulfurized product liquid and is collected by gas-liquid separator 20 and directed via conduit 29 to pump 31 for pumping via conduit 35, through optional heat exchanger 33 to cool the pumped-up liquid, to the top of reactor 10 for further processing before final discharge from reactor 10.

The fresh hydrogen gas stream introduced via gas feed line 38 and highly desulfurized liquid pumped-up from gas-liquid separator 21 are distributed over upper catalyst bed 12 by gas-liquid distributor 28 and flow downwardly through upper catalyst bed 12 in co-current contact. Further desulfurization occurs in the upper catalyst bed, producing a very highly desulfurized product liquid and a vapor containing unreacted hydrogen as well as hydrogen sulfide, light hydrocarbon gas and, possibly, ammonia. The vapor continues through gas-liquid separation zone 20 into the middle reaction zone where it mixes with the pumped-up liquid feedstock introduced through conduit 36 and reacts with the pumped-up liquid over the middle bed catalyst 13. The liquid exiting upper catalyst bed 12 is a very highly desulfurized product liquid and is collected by gas-liquid separator 20 and directed via product line 40 for storage or further processing.

Figure 3:
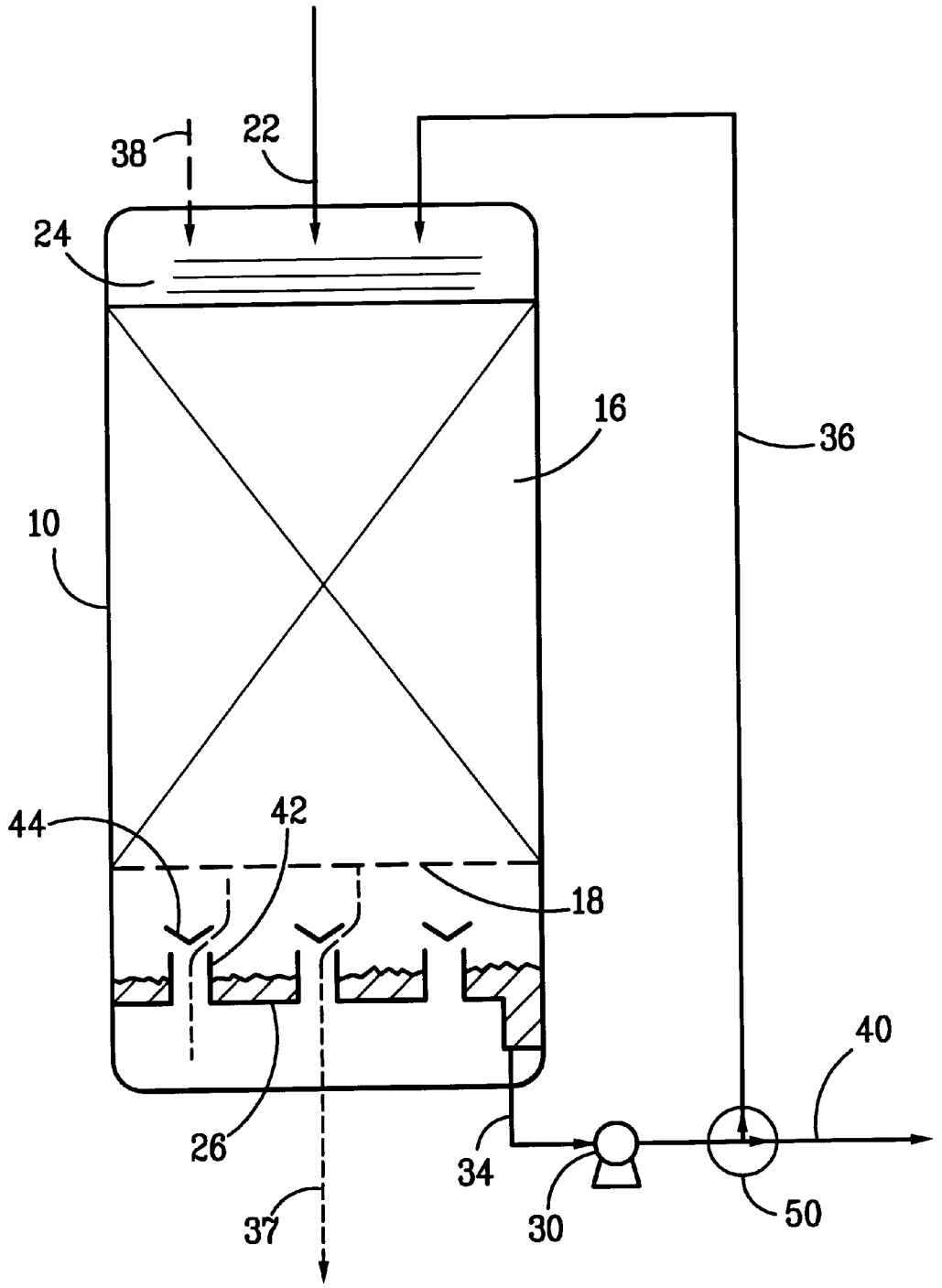
FIG. 3 is a simplified process diagram showing a vertical bed having a single fixed catalyst bed and major flow streams in connection with another embodiment of the present invention.

Many of the benefits and advantages of the multiple bed with pump-up recycle of the liquid stream exiting the catalyst bed hydroprocessing process and reactor system illustrated in FIG. 1 can be achieved with the more simplified arrangement of FIG. 3. In particular, the FIG. 3 arrangement affords the opportunity to reprocess the heavy end components which often require more intense processing. Referring now to FIG. 3, wherein like numerals designate like or equivalent elements in FIG. 1, a continuous catalytic hydroprocessing reactor system comprises reactor 10 which contains a catalyst bed 16 supported on catalyst support grid 18. The bed is packed with a hydroprocessing catalyst which is suitable for the hydroprocessing reaction system which is intended to occur in the reaction zone. A gas-liquid distributor 24 disperses the feed hydrogen gas in the feed liquid feedstock and/or in the liquid pumped up from the gas-liquid separator 26 at the bottom of reactor 10 and uniformly distributes the liquid and gas over the catalyst bed. A gas-liquid separator and liquid collector 26, e.g., utilizing chimney trays 42 and V-hats 44, is positioned at the bottom of the reactor at the exit of catalyst bed 16 for separating the gas effluent from the liquid which has just passed through catalyst bed 16 before the liquid is either collected and directed to storage or for further processing or pumped-up to the top of reactor 10.

In operation, liquid feedstock is pumped into the top of the reactor 10 via liquid feed line 22 above catalyst bed 16 and through gas-liquid distributor 24. Typically, the feedstock is in a preheated condition as a result of passage through upstream heat exchangers (not shown). The fresh hydrogen gas stream introduced via gas feed line 38 and the liquid feedstock and/or pumped-up liquid are distributed over catalyst bed 16 by gas-liquid distributor 24 and flow downwardly through catalyst bed 16 in co-current contact. Most of the sulfur is removed from the liquid feedstock, hydrogen is consumed in the desulfurization reaction which takes place, hydrogen sulfide and, possibly, ammonia are produced and low boiling hydrocarbons in the liquid feedstock are vaporized. The resulting largely desulfurized liquid, which comprises mostly higher boiling hydrocarbons is collected either as the final desulfurized product liquid or for recycle to the top of the reactor 10 for further processing in co-current contact with feed hydrogen. If the liquid exiting the bottom of reactor 10 is satisfactory as the final desulfurized product, the liquid is directed via conduit 34 into pump 30 and valve 50 is adjusted to divert the liquid flow into product line 40. However, in circumstances where the liquid exiting the bottom of reactor 10 needs further hydroprocessing, valve 50 is adjusted to divert the liquid flow through conduit 36 to the top of reactor 10 for reintroduction into catalyst bed 16. This allows focused reprocessing of the higher boiling hydrocarbons (generally boiling above 500° F.) and increases the liquid traffic in the reactor, thus improving wet packing therein and helping to prevent hot spots. The gas effluent from the lower end of the reactor 10 may be directed to a separate system for recovering recycle hydrogen for use in the hydroprocessing reactor.

Typical hydroprocessing conditions in which the reactor and process of the present invention may be advantageously employed include a temperature range of from about 550° to 950° F. and reactor pressures of from 100 to 5,000 psig. The liquid hourly space velocity (LHSV) may be in the range from about 0.1 $hr^{-1}$ to about 10 $hr^{-1}$. The total hydrogen to the reactor (fresh hydrogen feed plus recycle hydrogen) is in the range of from 300 to 5,000 standard cubic feet of hydrogen per barrel of feedstock. It will be appreciated that, generally within the aforementioned ranges, different preferred reaction conditions will apply for different types of hydroprocessing reactions.

The catalysts employed in the process of the present invention may consist of any conventional hydroprocessing catalyst. In general, the oxides and sulfides of transitional metals are useful, and especially the Group VIb and Group VIII metal oxides and sulfides. In particular, combinations or composites of one or more Group VIb metal oxides or sulfides with one or more of group VIII metal oxides or sulfides is generally preferred. For example, combinations of nickel-tungsten oxides and/or sulfides, cobalt-molybdenum oxides and/or sulfides and nickel-molybdenum oxides and/or sulfides are particularly contemplated. However, iron oxide, iron sulfide, cobalt oxide, cobalt sulfide, nickel oxide, nickel sulfide, chromium oxide, chromium sulfide, molybdenum oxide, molybdenum sulfide, tungsten oxide or tungsten sulfide, among others, may be used.

The catalyst is preferably supported on a relatively inert carrier. Generally, minor proportions of the active metal compounds are used, ranging between about 1% and 25% by weight. Suitable carriers include, but are not limited to, alumina, silica, kieselguhr, diatomaceous earth, magnesia, zirconia, titania, or other inorganic oxides, or zeolites, alone or in combination.

The catalysts may be the same throughout the whole reactor, or may be different, as suits the proposed process. For example, for a process such as hydrodesulfurization, the upper bed catalyst may be a more active and more selective catalyst, albeit less robust, e.g., Pt/zeolite, than is used in the lower bed, since the upper bed sees full fresh hydrogen and largely desulfurized liquid which is pumped-up from the reactor bottom. Thus, the upper bed catalyst need not be as resistant to fouling since it will not encounter the highly sulfur-contaminated hydrocarbons. This ability to utilize different catalysts in the various beds of the reactor enables a new range of processing possibilities in a single reactor, including the ability to conduct different hydroprocessing reactions in different beds of the reactor.

The process of the present invention is adaptable to a variety of interphase catalytic reactions, particularly for treatment of heavy oils with hydrogen-containing gas at elevated temperatures and pressures. For this reason, depending upon the hydroprocessing reaction to be used, any number of liquid feedstock materials are suitable. In particular, feedstocks which may be treated in accordance with the present process include, in general, any mineral oil stock having an end boiling point in excess of about 500° F. In the use of such feedstocks the heavy ends will constitute a relatively fixed and unchanging liquid phase during hydroprocessing while the light ends will generally vaporize. Specific examples of such stocks include crude oils, reduced crude oils, deasphalted reduced crude oils, light gas oils, heavy gas oils, kerosene-gas oil fractions, heavy naphtha-gas oil fractions, fuel oil fractions, and the like. These stocks may be derived from petroleum, shale, tar sands and similar natural deposits.

The numerous advantages of the present invention, particularly in terms of increased yield at constant throughput and/or increased throughput at constant yield, can be demonstrated through the use of a simple kinetic example. One reaction is considered in the example:

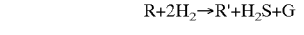

$$R+2H_2 \rightarrow R'+H_2S+G$$

wherein R' is the desulfurized form of the feed R, and G represents a mole of light hydrocarbon gas byproduct. The rate of conversion of R is proportional to the amount of R and to the partial pressure of $H_2$, while the partial pressure of H2S inhibits the conversion reaction. The rate expression is:

$$\frac{dn_r}{dt} = \frac{(-1)n_r y_{H2}}{1+10y_{H2S}}$$

where $n_r$=moles of R and $y_{H2}$ and $yH_{H2S}$ are mole fractions in the gas phase. The total pressure is some constant value. The total dimensionless residence time in the bed is 5 units, and the total molar feed ratio of hydrogen (including recycle and quench) to R is 6. This model captures some key features of hydroprocessing kinetics without necessarily representing any particular commercial reaction.

Figure 4:
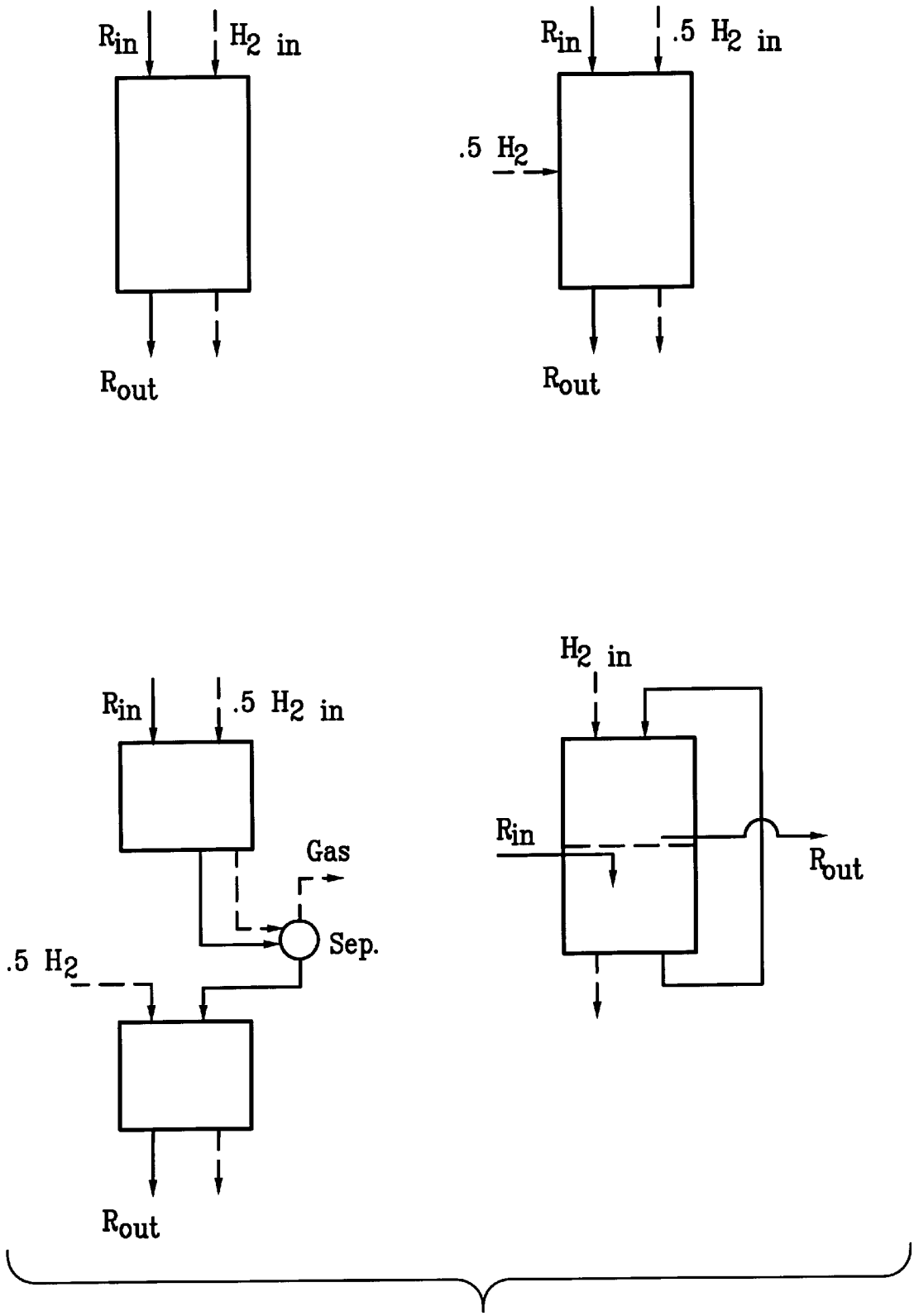
FIG. 4(*a*)–4(*d*) schematically illustrates comparative flow configurations for the same hydroprocessing reaction system for use with a simple kinetic model.

Referring to FIGS. 4(*a*)–4(*d*) there are schematically illustrated four different flow configurations and conversions for the above reaction, wherein feed $R_{in}$=100 moles, feed $H_{2\ in}$=600 moles and feed $0.5H_{2\ in}$=300 moles:

(a) Straight through. $R_{out}$=13 moles, indicating that 13% of the liquid feedstock was unreacted in this flow configuration.

(b) Straight through with split $H_2$ feed (e.g., a two bed reactor with quench hydrogen feed). $R_{out}$=17.2 moles, indicating that 17.2% of the liquid feedstock was unreacted in this flow configuration.

(c) Two reactors in series with interstage gas removal and interstage $H_2$ feed. $R_{out}$=10.6 moles, indicating that 10.6% of the liquid feedstock was unreacted in this flow configuration.

(d) Configuration of the present invention including a two bed reactor with liquid pump-up from the bottom of the lower bed to the top of the upper bed. $R_{out}$=6.9 moles, indicating that 6.9% of the liquid feedstock was unreacted in this flow configuration.

It is noteworthy that the process and reactor configuration of the present invention provides significantly more desulfurization of the liquid feedstock than a straight through reactor (6.9% unconverted v. 13% unconverted) and a split hydrogen feed reactor (6.9% unconverted v. 17.2% unconverted). It also substantially outperformed a two reactor system with interstage gas removal and split hydrogen feed (6.9% unconverted v. 10.6% unconverted).

Another way of comparing flow configurations is at constant conversion rather than constant throughput. For example, the throughput for the process and reactor of the present invention could be nearly doubled to feed R=185 moles and feed $H_2$=1110 moles and still maintain a better conversion yield than the straight through flow configuration shown in FIG. 3(*a*) (12.9% unconverted v. 13% unconverted).

It will be appreciated from the foregoing description of the process and reactor of the present invention that its adoption and use could confer significant benefits as contrasted with conventional hydroprocessing operations. One major advantage is the ability to increase the throughput at current levels of conversion e.g., desulfurization). Another advantage is the ability to obtain greater conversion at constant throughput levels. In addition the manner in which the beds are staged in the process of the present invention allows the use of more active yet more sensitive or selective catalysts, at least in the upper bed, in applications where they normally cannot be used. Moreover, the pumping-up of liquid from the bottom of the lower reaction zone typically means that the heavier components (e.g., above 500° to above 700° F. cuts) will be recycled to the upper reaction zone for further processing. This allows more focused processing of heavier components which often, as in hydrodesulfurization and hydroisomerization, need more intense processing without overconverting the lighter components.

While the invention has been described primarily by reference to hydrodesulfurization of liquid feedstock having a high sulfur contaminant level, it will be appreciated that the process is applicable to a large number of hydroprocessing reaction systems and to a wide variety of hydrocarbon feedstocks without regard to their origin. Accordingly the scope of this invention is intended to encompass functional equivalents of the specific embodiments described above and is not intended to be limited other than as set forth in the claims.

I claim:

1. A method for catalytic hydroprocessing liquid hydrocarbon feedstock at elevated temperatures and pressures for producing a liquid hydrocarbon product, comprising the steps of:

(a) introducing said feedstock into a reactor system having first and second reaction zones and a gas-liquid distributor at the entrance of each zone, each reaction zone having a hydroprocessing catalyst bed therein, said feedstock being introduced at the top of the second reaction zone, then passed through the gas-liquid distributor in order to assure full and adequate dispersion of the downflowing hydrogen-containing gas from the first reaction zone for downward flow through the catalyst bed therein;

(b) separating a partially reacted liquid effluent from the gas as both exit the bottom of the second reaction zone, while permitting gas downflow;

(c) directing said partially reacted liquid effluent to and introducing it at the top of said first reaction zone for downward flow through the catalyst bed therein;

(d) introducing hydrogen gas at the top of the first reaction zone for flow downwardly and sequentially through and over the catalyst beds in the first and second reaction zones in co-current contact with the liquid in said reaction zones, said hydrogen reacting with said liquid in said reaction zones whereby the liquid effluent from the first reaction zone comprises a liquid hydrocarbon product; and (e) separating the liquid hydrocarbon effluent product from the gas as both exit the bottom of the first reaction zone, while permitting gas downflow.

2. The method recited in claim 1, wherein said first and second reaction zones are vertically spaced apart with said first reaction zone above said second reaction zone.

3. The method recited in claim 1, wherein said step of directing said partially reacted liquid effluent to the top of said first reaction zone comprises pumping said liquid effluent from said second reaction zone to the top of said first reaction zone.

4. The method recited in claim 2, wherein said step of directing said partially reacted liquid effluent to the top of said first reaction zone comprises pumping said liquid effluent from said second reaction zone to the top of said first reaction zone.

5. The method recited in claim 2, including the step of cooling said liquid effluent enroute to said first reaction zone.

6. The method recited in claim 3, wherein the reaction between said liquid and said hydrogen in said second reaction zone produces a gaseous effluent comprising unreacted hydrogen, low boiling hydrocarbon vapors and reaction product vapors, collecting said gaseous effluent from said second reaction zone by separating it from the liquid hydrocarbon effluent, processing said gaseous effluent to recover a hydrogen-rich gaseous stream and recycling said hydrogen-rich stream to the top of said first reaction zone.

7. The method of claim 1, wherein the feedstock is a mineral oil stock having an end boiling point in excess of about 500° F.

8. The method of claim 7, wherein the feedstock is selected form the group consisting of crude oils, reduced crude oils, light gas oils, deasphalted reduced crude oils, light gas oils, heavy gas oils, kerosene gas oil fractions, heavy naphtha gas oil fractions, and fuel oil fractions.

9. The method of claim 1, whereby gas is separated from liquid effluent in steps (b) and (e) by the use of v hats, which divert gas downward, and chimney trays, which collect liquid.

10. The method of claim 1, wherein hydroprocesing conditions include a temperature range of from about 550 to 950 F., pressure range of from 100 to 5000 psig, a liquid hourly space velocity in the range from about 0.1 $hr^{-1}$ to about 10 $hr^{-1}$ and total hydrogen to the reactor is in the range of from 3000 to 5000 standard cubic feet of hydrogen per barrel of feedstock.

11. The method of claim 1, wherein the second reaction zone employs catalysts comprising composites of one or more Group VIb metals oxides or sulfides with one or more Group VIII metal oxides or sulfides, and the first reaction zone employs a catalyst comprising a zeolite in combination with platinum.

* * * * *